US008029860B2

(12) United States Patent
Kobayashi

(10) Patent No.: US 8,029,860 B2
(45) Date of Patent: Oct. 4, 2011

(54) MANUFACTURING METHOD FOR A NOZZLE PLATE AND A NOZZLE PLATE

(75) Inventor: Yasunori Kobayashi, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 222 days.

(21) Appl. No.: 12/480,858

(22) Filed: Jun. 9, 2009

(65) Prior Publication Data

US 2009/0304990 A1 Dec. 10, 2009

(30) Foreign Application Priority Data

Jun. 9, 2008 (JP) ..... 2008-150016

(51) Int. Cl.
*B41J 2/135* (2006.01)
*B41J 2/16* (2006.01)
*B41J 2/165* (2006.01)

(52) U.S. Cl. ..... 427/264; 427/256; 427/258; 427/261; 427/270; 427/271; 427/275; 427/265; 427/276; 427/277; 427/58; 427/100; 427/102; 427/103; 347/1; 347/20; 347/22; 347/33; 347/40; 347/44; 347/45; 347/47; 347/55; 347/68; 347/71; 347/72

(58) Field of Classification Search ..... 427/258, 427/261, 100, 264, 271, 277; 347/1, 20, 347/22, 33, 44, 45, 47
See application file for complete search history.

(56) References Cited

U.S. PATENT DOCUMENTS

2006/0012656 A1* 1/2006 Suzuki et al. ..... 347/100
2006/0152550 A1 7/2006 Tomita et al.

FOREIGN PATENT DOCUMENTS

JP H04-176657 A 6/1992
JP 2005-007789 A 1/2005
JP 2005053064 A * 3/2005
JP 2006-192622 A 7/2006
JP 2006-256165 A 9/2006
JP 2007-050583 A 3/2007

OTHER PUBLICATIONS

Machine Translation of Shimizu et al. (JP 2006-256165) with drawings. (no date available).*

* cited by examiner

*Primary Examiner* — Michael Cleveland
*Assistant Examiner* — Lisha Jiang
(74) *Attorney, Agent, or Firm* — Baker Botts L.L.P.

(57) ABSTRACT

A manufacturing method for a nozzle plate including a plurality of nozzle holes may include the step of forming a plurality of through-holes extending through a plate member in a thickness direction of the plate member. The manufacturing method may also include the step of forming a water repellant film in a region of one surface of the plate member where apertures of the through-holes are not positioned. The manufacturing method may further include the step of pressing individual regions on the one surface of the plate member, the individual regions respectively including the apertures of the through holes, to separate at least portions of the water repellant film formed in the individual regions from the water repellant film formed on the one surface.

9 Claims, 9 Drawing Sheets

MANUFACTURING METHOD FOR A NOZZLE PLATE AND A NOZZLE PLATE

CROSS REFERENCE TO RELATED APPLICATIONS

This application claims priority to Japanese Patent Application No. 2008-150016, filed Jun. 9, 2008, the entire subject matter and disclosure of which is incorporated herein by reference.

BACKGROUND OF THE INVENTION

1. Field of the Invention

The present invention relates to a manufacturing method for a nozzle plate including a plurality of nozzle holes from which liquid is discharged and a nozzle plate including a plurality of nozzle holes from which liquid is discharged.

2. Description of the Related Art

A known recording apparatus for forming images by discharging ink includes a nozzle plate having a plurality of nozzle holes from which ink is discharged. In an inkjet head of the recording apparatus, recesses are provided on a surface of the inkjet head from which ink is discharged, and nozzle holes open on bottom faces of the recesses. The surroundings of the nozzle holes on the bottom faces of the recesses are covered with a water repellant film, but inner side faces of the recesses are not covered with a water repellant film. Since this allows ink to easily move onto the inner side faces of the recesses, the ink becomes unlikely to adhere near the nozzle holes on the bottom faces of the recesses. Thus, ink can be stably discharged from the nozzle holes.

In the inkjet head of the recording apparatus, the nozzle holes and recesses are formed in two plates, namely, a cover plate and a nozzle plate, in the following manner. First, holes functioning as recesses are formed in the cover plate, and holes functioning as nozzle holes are formed in the nozzle plate. Next, a water repellant film is formed on a surface of each of the cover plate and the nozzle plate. Next, the surface of the cover plate that is not covered with the water repellant film is joined to the surface of the nozzle plate that is covered with the water repellant film. Recesses are thereby defined by the holes of the cover plates and the surface of the nozzle plate. Since the interiors of the holes of the cover plate are not covered with the water repellant film, side faces of the recesses are not covered with the water repellant film.

When two plates respectively having the holes functioning as the recesses and the nozzle holes are joined together after a water repellant film is formed on each of the plates, the total number of steps in the manufacturing procedure may become too large.

SUMMARY OF THE INVENTION

A need has arisen for a manufacturing method for easily producing a nozzle plate capable of stably discharging ink and a nozzle plate that is easily produced and capable of stably discharging ink.

According to one embodiment herein, a manufacturing method for a nozzle plate including a plurality of nozzle holes may include the step of forming a plurality of through-holes extending through a plate member in a thickness direction of the plate member. The manufacturing method may also include the step of forming a water repellant film in a region of one surface of the plate member where apertures of the through-holes are not positioned. The manufacturing method may further include the step of pressing individual regions on the one surface of the plate member to form recesses in the individual regions, the individual regions respectively including the apertures of the through holes, and the recesses including bottom faces closer to the other surface than the one surface, and to separate at least portions of the water repellant film formed in the individual regions from the water repellant film formed on the one surface.

According to another embodiment herein, a manufacturing method for a nozzle plate including a plurality of nozzle holes may include the step of forming a water repellant film for covering one surface of a plate member. The manufacturing method may also include a step of forming a plurality of holes opening on the other surface of the plate member. The manufacturing method may further include a step of pressing individual regions positioned on the one surface of the plate member and respectively including the holes, as viewed in a thickness direction of the plate member so as (a) to form recesses in the individual regions, the recesses including bottom faces closer to the other surface than the one surface, (b) to separate at least portions of the water repellant film formed in the individual regions from the water repellant film formed outside the individual regions, and (c) to form through holes extending from the one surface to the holes.

According to yet another embodiment herein, a manufacturing method for a nozzle plate including a plurality of nozzle holes may include the step of forming a plurality of through-holes extending through a plate member in a thickness direction of the plate member. The manufacturing method may also include the step of forming a water repellant film in a region of one surface of the plate member where apertures of the through-holes are not positioned. The manufacturing method may further include the step of pressing individual regions on the one surface of the plate member, the individual regions respectively including the apertures of the through holes, to separate at least portions of the water repellant film formed in the individual regions from the water repellant film formed on the one surface.

According to yet another embodiment herein, a nozzle plate may include a plurality of nozzle holes from which liquid is discharged, a plate member, a plurality of through-holes extending through the plate member in a thickness direction of the plate member, and a water repellant film formed in a region of one surface of the plate member where apertures of the through-holes are not positioned. At least portions of the water repellant film formed in the individual regions that respectively include the apertures of the through holes may be separated from the water repellant film formed on the one surface in a planar direction of the plate member.

Other objects, features and advantages of the present invention will be apparent to those skilled in the art from the following detailed description and accompanying drawings.

BRIEF DESCRIPTION OF THE DRAWINGS

Exemplary embodiments of the invention are described below with reference to the accompanying drawings in which.

DETAILED DESCRIPTION OF EXEMPLARY EMBODIMENTS

Various embodiments, and their features and advantages, may be understood by referring to FIGS. 1-9, like numerals being used for corresponding parts in the various drawings.

Figure 1:
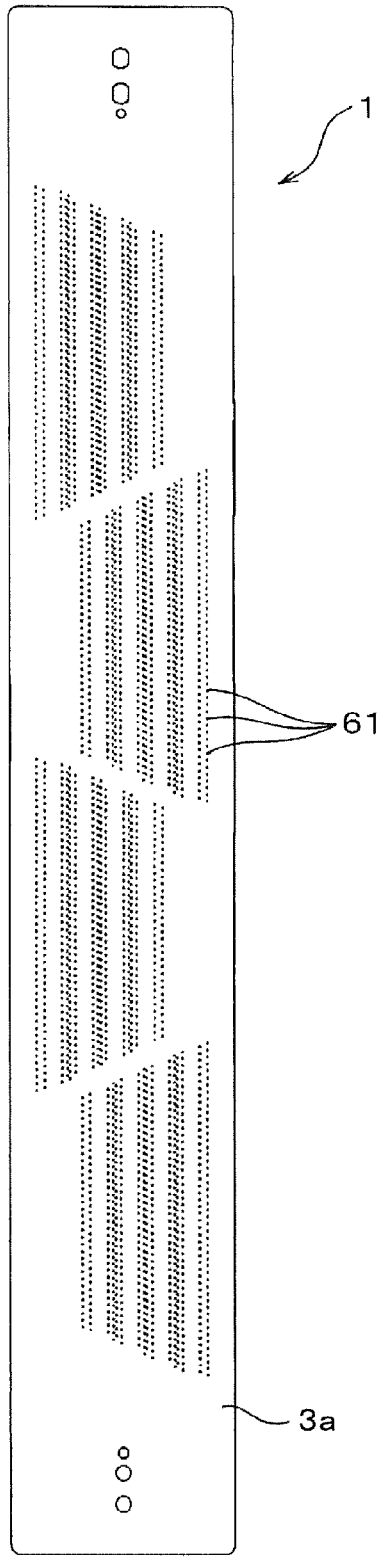
FIG. 1 is a bottom view of a nozzle plate.

Referring to FIG. 1, the nozzle plate 1 is shaped like a rectangle that is long in a main-scanning direction. A plurality of discharging ports 61 functioning as apertures for discharging liquid are two-dimensionally arranged in a matrix on a discharging surface 3*a* functioning as a bottom surface of the nozzle plate 1. The discharging ports 61 have a diameter of 20 μm, and are formed by apertures provided on one side (i.e., discharging side) of nozzle holes 51 (see FIG. 2) of the nozzle plate 1. The discharging ports 61 are provided in a plurality of, e.g., four, discharging regions that have almost the same trapezoidal shape as that of a plurality of, e.g., four, actuator units 121 (see FIGS. 7A and 7B).

Figure 2:
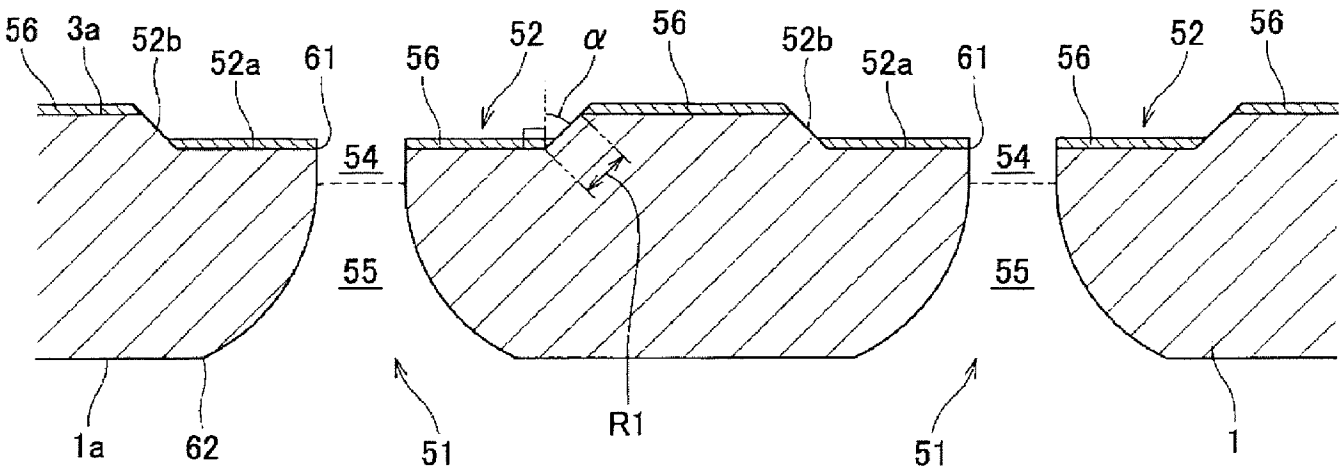
FIG. 2 is an enlarged partial cross-sectional view of the nozzle plate.
Figure 3:
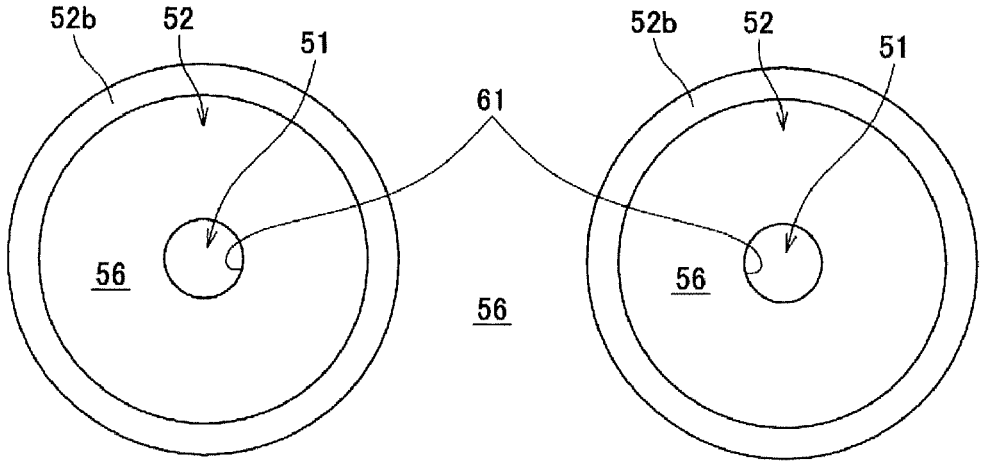
FIG. 3 is an enlarged partial bottom view of the nozzle plate.

In the following description, it is assumed that upper and lower sides refer to upper and lower sides of the nozzle plate 1 oriented, as shown in FIG. 2. Referring to FIG. 2 and FIG. 3, the nozzle plate 1 includes a discharging surface 3*a* on which the discharging ports 61 are provided, and a connecting surface 1*a* opposite the discharging surface 3*a*. On the discharging surface 3*a*, a plurality of recesses 52 are provided. The recesses 52 are shaped like a circle having a diameter of about 100 μm in plan, and are spaced from one another. The depth of the recesses 52, that is, the distance from the discharging surface 3*a* to bottom faces 52*a* of the recesses 52 is within the range of 1 to 5 μm. Side faces 52*b* provided between the discharging surface 3*a* and the bottom faces 52*a* are annular inclined faces that extend outward from the bottom faces 52*a* toward the discharging surface 3*a*. More specifically, the side faces 52*b* each form a straight line having a distance R1 in FIG. 2. Here, the distance R1 corresponds to the shortest distance in the side face 52*b* from the bottom face 52*a* to the discharging surface 3*a*. Thus, areas extending from the bottom faces 52*a* to the discharging surface 3*a* via the side faces 52*b* are tapered at a taper angle α. The taper angle α is an acute angle formed between a direction orthogonal to the discharging surface 3*a* and the side faces 52*b* having the distance R1.

The nozzle plate 1 includes a plurality of nozzle holes 51 extending from the connecting surface 1*a* to the bottom faces 52*a* of the recesses 52. The nozzle holes 51 are through-holes provided between the circular discharging ports 61 provided in the discharging surface 3*a* and circular inlet ports 62 provided in the connecting surface 1*a*. Each nozzle hole 51 includes a columnar portion 54 having the discharging port 61 at one end and connected to the bottom face 52*a*, and a truncated conical portion 55 having the inlet port 62 at one end and connected to the connecting surface 1*a*. The top of the truncated conical portion 55 has the same diameter as that of the columnar portion 54. A peripheral surface of the truncated conical portion 55 is strictly not conical, but is shaped like a smooth curve that slightly bulges toward the inside of the nozzle hole 51, in the cross section shown in FIG. 2.

The bottom faces 52*a* of the recesses 52 and the discharging surface 3*a* are each covered with a water repellant film 56 having a thickness of 0.1 μm that is less than the depth of the recesses 52. The water repellant film 56 is formed of, for example, CYTOP™ from Asahi Glass Co., Ltd. The water replant film 56 on the discharging surface 3*a* is provided such as to avoid areas where the recesses 52 are provided. On each bottom face 52*a*, the water repellant film 56 has an annular shape such that an inner rim of the water repellant film 56 coincides with an outer rim of the discharging port 61 and an outer rim of the water repellant film 56 coincides with an outer rim of the bottom face 52*a*. The side face 52*b* is not covered with a water repellant film. In actuality, a portion of the side face 52*b* extending upward from a lower end to a height equal to the thickness of the water repellant film 56 is sometimes covered with a water repellant film 56, or the side face 52*b* is sometimes not covered with a water repellant film 56 at all. In FIG. 2, a portion of each side face 52*b* provided near the lower end having a height equal to the thickness of the water repellant film 56 is covered with the water repellant film 56. However, in this specification, such a state in which a portion of the side face 52*b* extending from the lower end to the height equal to the thickness of the water repellant film 56 is covered with the water repellant film 56, whose surface is parallel to the bottom face 52*a*, does not mean that "the side face of the recess is covered with the water repellant film".

In the above-described nozzle plate 1 of the embodiment, the water repellant film 56 is provided around the discharging ports 61, but is not provided on the side faces 52*b* of the recesses 52. For this reason, ink adhering near the discharging ports 61 easily moves away from the discharging ports 61, and discharging of ink from the discharging ports 61 is not hindered. Therefore, it is possible to stably discharge ink from the discharging ports 61.

In addition, since the discharging ports 61 of the nozzle holes 51 are provided in the bottom faces 52*a* of the recesses 52, a wiper for wiping the discharging surface 3*a* and a sheet jamming during printing do not easily touch the surroundings of the discharging ports 61. Hence, deformation of the discharging ports 61 can be prevented, and foreign matters, such as paper dust, are unlikely to adhere to the surroundings of the discharging ports 61. Moreover, the water repellant films 56 on the bottom faces 52*a* are unlikely to be damaged by a collision of the sheet.

Further, the bottom faces 52*a* of the recesses 52 respectively surround the discharging ports 61, and the recesses 52 are spaced from one another. Therefore, it is possible to restrain ink discharging from a discharging port 61 from being adversely affected by adjacent discharging ports 61.

In addition, since the side faces 52*b* of the recesses 52 are inclined such as to extend outward from the bottom faces 52*a* to the discharging surface 3*a*, for example, ink may be easily removed from the recesses 52 when wiping the discharging surface 3*a* of the nozzle plate 1 with the wiper blade.

Next, a manufacturing method for the nozzle plate 1 according to the embodiment will now be described with reference to FIGS. 4A to 4D. While descriptions will be given of one nozzle hole 51 and one recess 52 here, all nozzle holes 51 and all recesses 52 in the nozzle plate 1 may be formed in a method similar to the following method.

Figure 4A:
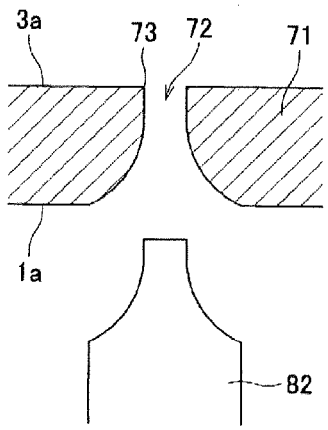
FIGS. 4A to 4D are cross-sectional views illustrating, in order, steps of a manufacturing method for the nozzle plate.

First, referring to FIG. 4A, a through-hole 72 is formed through a plate member 71, which is to be a nozzle plate 1, by driving a punch 82 into a connecting surface 1*a* of the plate member 71. The through-hole 72 has an aperture 73 on a discharging surface 3*a*. The punch 82 used here is shaped, near the tip thereof, such that the columnar portion 54 and the truncated conical portion 55 shown in FIG. 2 are connected and a columnar portion having a length equal to the depth of the recess 52 and having the same diameter as that of the columnar portion 54 is connected to the leading end of the columnar portion 54. When being driven, the punch 82 may penetrate the plate member 71, or does not always need to penetrate the plate member 71. In any case, a surface of the plate member 71 functioning as the discharging surface 3*a* is partly removed by mechanical polishing, and is shaped by lapping so that the discharging surface 3*a* becomes flat. Thus, a columnar hole including the columnar portion 54 of the nozzle plate 1 opens on the discharging surface 3*a*.

Figure 4B:
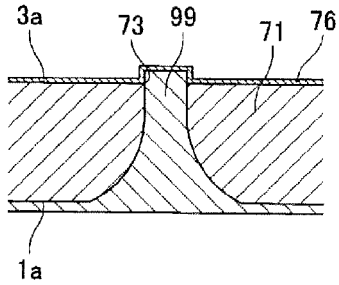

Next, referring to FIG. 4B, the through-hole 72 is filled with a mask material 99. Then, water repellant liquid 76 is applied onto the discharging surface 3*a* with a roller coater. Since the through-hole 72 is filled with the mask material 99, the water repellant liquid 76 is not applied on the inner surface of the through-hole 72, but is applied on only the discharging surface 3*a* and a surface of the mask material 99 exposed from the discharging surface 3*a*. Light curing resin is used as the mask material 99. When filling the mask material 99, a film of light curing resin is placed on the plate member 71 from the side of the connecting surface 1*a*, and is press-bonded with a roller or the like while being heated, so that part of the light curing resin protrudes from the discharging surface 3*a*. Further, by applying ultraviolet light parallel to the nozzle hole 51 from the side of the connecting surface 1*a*, the protruding part of the light curing resin is exposed along the columnar portion 54. An unexposed part of the light curing resin on the side of the discharging surface 3*a* is removed by a developing agent (e.g., an alkali solution containing 1% of $Na_2CO_3$). Consequently, the mask material 99 extends from the connecting surface 1*a* via the nozzle hole 51 so that a part thereof protrudes from the discharging surface 3*a*.

Figure 4C:
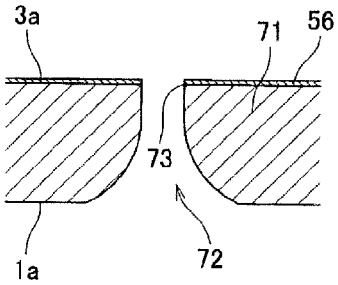

Next, referring to FIG. 4C, a water repellant film 56 is formed on the discharging surface 3*a* by drying the water repellant liquid 76. Then, the mask material 99 is removed from the through-hole 72 by using a releasing liquid (e.g., a NaOH 3-percent solution). In this case, the water repellant film 56 on the mask material 99 is removed (lifted off) together with the mask material. Since the mask material 99 protrudes from the discharging surface 3*a*, as described above, the water repellant film 56 is cut just at an end of the columnar hole after the mask material 99 is removed. For this reason, an aperture having the same size and the same shape as those of the columnar hole (aperture 73) is formed in the water repellant film 56.

Figure 4D:
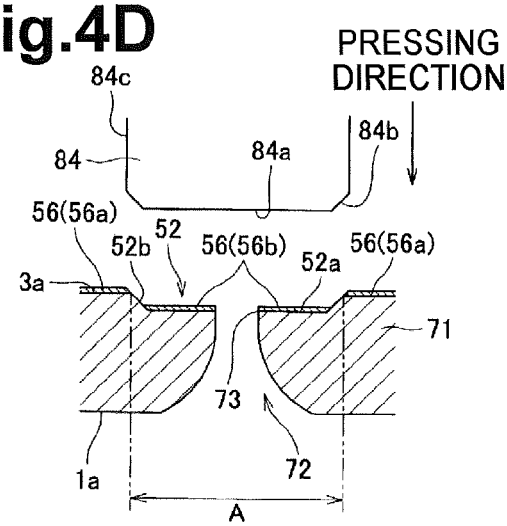

Finally, referring to FIG. 4D, a recess 52 is formed by driving a punch 84 into a predetermined region A (i.e., individual region) which includes the aperture 73 on the discharging surface 3*a* in plan view (i.e., pressing step). The aperture 73 is provided at the center of a bottom face 52*a*. The predetermined region A coincides with a region where the recess 52 is formed in the discharging surface 3*a*, and is provided inside the outer rim of the side face 52*b* shown in FIG. 3.

The punch 84 used here is shaped like a column, and the adjacency of the tip of the punch 84 has a shape corresponding to the recess 52. A leading end face 84*a* of the punch 84 is shaped like a circle having the same size as that of the outer rim of the bottom face 52*a* of the recess 52. A tapered face 84*b* is provided between an outer peripheral surface 84*c* and the leading end face 84*a* of the punch 84, and is shaped such as to be aligned with the side face 52*b* of the recess 52. Only a portion of the tapered face 84*b* close to the leading end face 84*a* may be aligned with the entire side face 52*b*, or the entire tapered face 84*b* may be aligned with the entire side face 52*b*.

The punch 84 is driven into the plate member 71 from the discharging surface 3*a* toward the connecting surface 1*a* so that the leading end face 84*a* reaches a position at a depth, which is more than the thickness of the water repellant film 56, from the discharging surface 3*a*. In this case, a portion 56*b* of the water repellant film 56 that is provided inside the region A moves toward the connecting surface 1*a* by an amount more than the thickness thereof, and is thereby broken and separated from a portion 56*a* outside the region A. The portion 56*b* is pushed in by the leading end face 84*a*, a bottom face 52*a* of a recess 52 is formed at a position closer to the connecting surface 1*a* than the discharging surface 3*a*, and the portion 56*b* of the water repellant film 56 inside the region A covers an upper surface of the bottom face 52*a*. Further, a side face 52*b* is formed between the bottom face 52*a* and the discharging surface 3*a* and along the tapered face 84*b* of the punch 84. Since the side face 52*b* is formed in a separate portion of the water repellant film 56, it is not covered with the water repellant film 56, and the plate member 71 is exposed thereat.

When the recess 52 is formed with the punch 84, the portion of the water repellant film 56 inside the region A is separated from the portion of the water repellant film 56 outside the region A so as to cover the bottom face 52*a* of the recess 52. Thus, in the produced nozzle plate 1, the side face 52*b* formed between the bottom face 52*a* of the recess 52 and the discharging surface 3*a* is not covered with the water repellant film 56, and the discharging surface 3*a* and the bottom face 52*a* of the recess 52 are covered with the water repellant film 56.

In the manufacturing method according to the above-described embodiment, the through-holes 72 that are to be the nozzle holes 51 are formed in the single nozzle plate 1, and the water repellant film 56 is not formed in the through-holes 72, but is formed on only the discharging surface 3*a*. In this way, not only the procedure for forming the water repellant film 56 may be simplified, but also it may be unnecessary to separately form holes in the two plates and to join the plates. Therefore, it may be possible to reduce the total number of manufacturing steps.

While the water repellant film 56 is formed by applying the water repellant liquid 76 onto the discharging surface 3*a* in the above-described manufacturing method, a nickel film containing PTFE (i.e., polytetrafluoroethylene) particles may be formed by electrolytic plating or electroless plating after the mask material 99 is formed, as described above. Alternatively, the water repellant film 56 may be directly formed by vacuum evaporation. In any case, the water repellant film 56 on the mask material 99 is removed by removing the mask material 99. When vacuum evaporation is used, evaporated particles tend to travel straight, and therefore, for example, the use of the mask material 99 shown in FIG. 4B may be eliminated. In this case, it may be unnecessary to fill the mask material 99 before evaporation and to remove the mask material 99 after evaporation, and the procedure may be simplified. Moreover, it may be possible to reduce damage to the water repellant film 56 due to the releasing agent for removing the mask material 99.

Descriptions will be given below of manufacturing methods according to first and second modifications of the above-described embodiment.

Figure 5A:
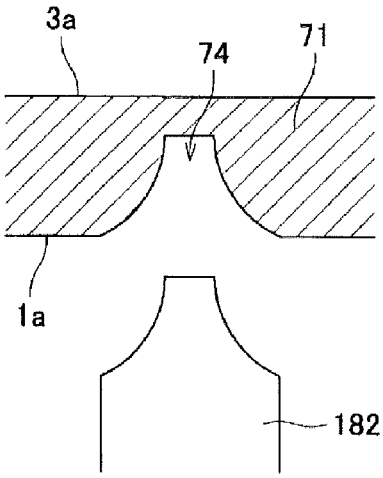
FIGS. 5A to 5C are enlarged partial cross-sectional views of a nozzle plate according to a first modification.

In the first modification, referring to FIG. 5A, a hole 74 is formed by driving a punch 182 into a connecting surface 1*a* of a plate member 71. The hole 74 may not extend through the plate member 71. The adjacency of the tip of the punch 182 has the same shape as that of the truncated conical portion 55 shown in FIG. 2. After that, a surface of the plate member 71 functioning as a discharging surface 3*a* is partly removed by mechanical polishing, and is shaped by lapping so that the discharging surface 3*a* becomes flat.

Figure 5B:
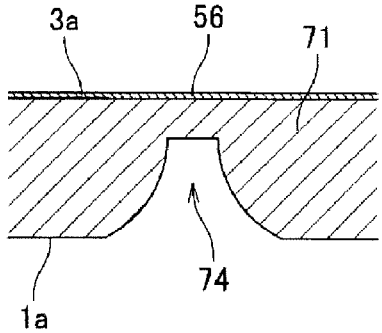

Next, referring to FIG. 5B, a water repellant film 56 is formed by applying a water repellant liquid onto the discharging surface 3*a* by spin coating, and then drying the water repellant liquid. Unlike the above-described embodiment, since the hole 74 may not extend through the plate member 71 in the first modification, even when the water repellant liquid is applied onto the discharging surface 3*a*, it is prevented from entering the hole 74. Instead of applying and drying the water repellant liquid, the water repellant film 56 may be formed by plating or evaporation that are described in the above embodiment.

Figure 5C:
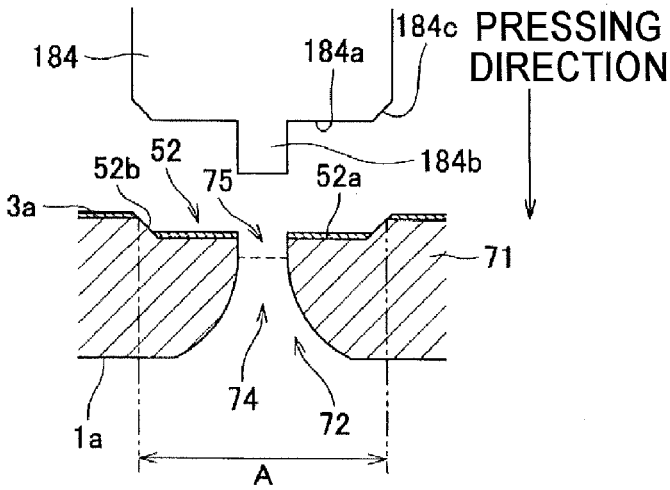

Finally, referring to FIG. 5C, a recess 52 is formed by driving a punch 184 into a predetermined region A of the discharging surface 3*a* including an aperture 73 in plan view (i.e., pressing step). The punch 184 used here is shaped by adding a protruding portion 184*b* to the above-described punch 84. The protruding portion 184*b* is shaped like a column, and protrudes from a leading end face 184*a* of the punch 184 toward the discharging surface 3*a*. The diameter of the protruding portion 184*b* is equal to the diameter of the columnar portion 54 shown in FIG. 2. Portions of the punch 184 other than the protruding portion 184*b* are similar to those of the punch 84.

The punch 184 is driven into the plate member 71 from the discharging surface 3*a* toward the connecting surface 1*a* so that the leading end face 184*a* reaches a position at a depth, which is more than the thickness of the water repellant film 56, from the discharging surface 3*a*. In this case, a bottom face 52*a* is formed at a position closer to the connecting surface 1*a* than the discharging surface 3*a*, and a portion of the water repellant film 56 inside the region A is broken and separated from a portion of the water repellant film 56 outside the region A. Further, a side face 52*b* is formed along a tapered face 184*c*. Thus, the formed recess 52 includes the bottom face 52*a* covered with the water repellant film 56 and the side face 52*b* that is not covered with the water repellant film 56.

At the same time when the recess 52 is formed by the leading end face 184*a* and the tapered face 184*c*, the protruding portion 184*b* is put into the plate member 71 from the bottom face 52*a* so as to reach the hole 74, so that a hole 75 extending straight in the pressing direction is formed. The hole 75 allows the recess 52 to communicate with the hole 74, and forms a through-hole 72 in conjunction with the hole 74.

While the columnar portion 54 and the truncated conical portion 55 are connected by connecting the open ends having the same size and shape in the above-described embodiment and modification, the aperture of the columnar portion 54 may be slightly smaller than that of the truncated conical portion 55. In this case, an allowance is formed in the accuracy in positioning the hole 74 and the punch 184 when forming the columnar portion 54 with the punch 184.

According to the above-described first modification, the hole 74 to be the columnar portion 54 of the nozzle hole 51 is formed in the step of forming the recess 52. Therefore, it may be unnecessary to form the through-hole 72 functioning as the nozzle hole 51 before the step of forming the water repellant film 56, and it is only necessary to form the hole 74 corresponding to the truncated conical portion 55 so that the hole 74 may not extend through the plate member 71. This may avoid the trouble of filling the through-hole 72 with a mask material in order to prevent entry of the water repellant liquid when forming the water repellant film 56.

Unlike the first modification, the recess 51 and the hole 75 functioning as the columnar portion 54 of the nozzle hole 51 may be formed with the punch 184 after a through-hole is formed in the plate member 71 and the water repellant film 56 is then formed. For example, the punch 184 may be driven into the region A in the state shown in FIG. 4C, and the protruding portion 184*b* may be put in from the aperture 73 of the through-hole 72 so as to form the recess 52 and the hole 75 functioning as the columnar portion 54. In this case, even if the columnar portion 54 is not satisfactorily formed in the state shown in FIG. 4C, it may be reliably formed by properly shaping the adjacency of the aperture 73 of the through-hole 72 in the step of forming the recess 52. Further, in the state shown in FIG. 4C, the diameter of the protruding portion 184*b* of the punch 184 may be slightly larger than the diameter of the aperture 73 of the through-hole 72. In this case, even when part of the water repellant film 56 on the mask material 99 remains after the mask material 99 is removed, the water repellant film 56 is shaped along the open end of the columnar portion 54.

Figure 6:
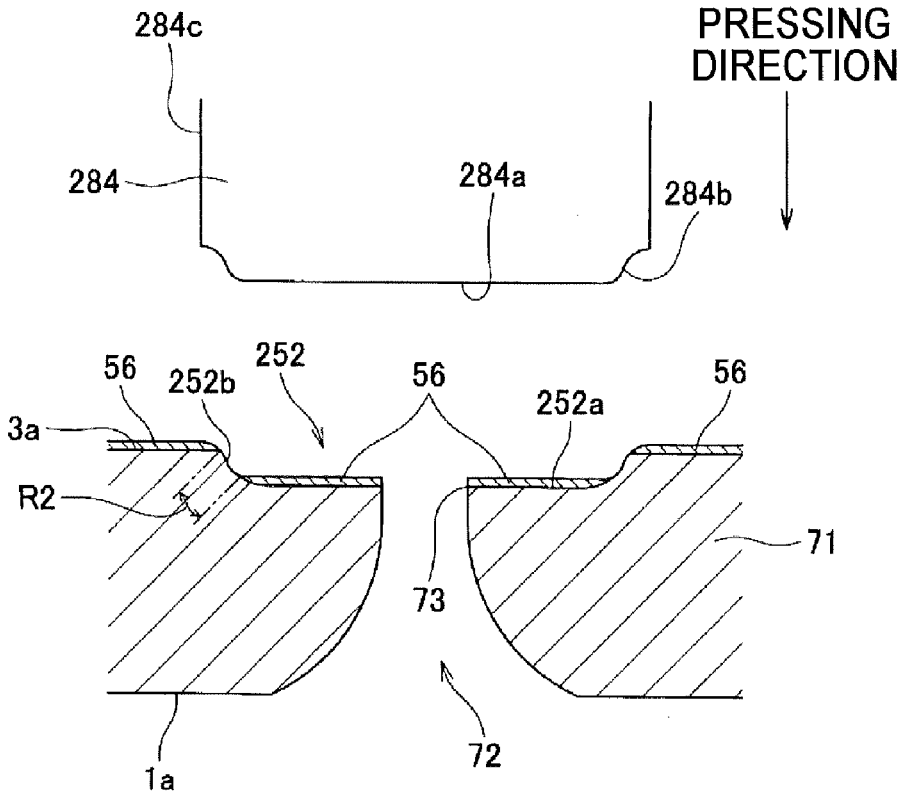
FIG. 6 is an enlarged partial cross-sectional view of a nozzle plate according to a second modification.

A second modification will now be described. The second modification is different from the above-described embodiment in a step of forming a recess. In the second modification, pressing is performed with a punch 284, as shown in FIG. 6. A curved end face 284*b* is provided between a leading end face 284*a* and an outer peripheral surface 284*c* of the punch 284. Structures other than the end face 284*b* may be similar to those of the above-described punch 84.

The punch 284 is driven into a plate member 71 from a discharging surface 3*a* toward a connecting surface 1*a* so that the leading end face 284*a* reaches a position at a depth more than the thickness of a water repellant film 56, whereby a recess 252 including a bottom face 252*a* covered with the water repellant film 56 and a side face 252*b* that is not covered with the water repellant film 56 is formed. The bottom face 252*a* may be formed in a manner similar to that adopted for the above-described bottom face 52*a*. On the other hand, the side face 252*b* is curved along the end face 284*b* of the punch 284 so as to extend outward from the bottom face 252*a* toward the discharging surface 3*a*. That is, a smoothly curved portion having a distance R2 is formed, as shown in FIG. 6. The distance R2 corresponds to the shortest distance in the side face 252*b* from the bottom face 252*a* toward the discharging surface 3*a*.

Since the side face 252*b* is thus smoothly and continuously curved from the bottom face 252*a* toward the discharging surface 3*a*, when the discharging surface 3*a* is wiped by a wiper blade, a contact portion of the wiper blade may smoothly move along the side face 252*b*. Therefore, ink may be easily removed from the recess 252. Moreover, since the side face 252*b* also extends outward from the bottom face 252*a* toward the discharging surface 3*a* in the second modification, when the discharging surface 3*a* is wiped by the wiper blade, ink may be easily removed from the recess 252.

By using the punch shaped corresponding to the shape of the recess in pressing, as in the above-described second modification, a recess of a desired shape may be formed easily. Similarly to the first modification, the through-hole 72 may be formed before the punch 284 is driven into the plate member 71, or a hole 74 reaching the midpoint in the plate member 71 in the thickness direction may be formed in the second embodiment. Further, a through-hole having a diameter smaller than the diameter of the columnar portion 54 may be formed in the plate member 71 beforehand. These structures may provide advantages similar to those of the second modification.

Figure 7A:
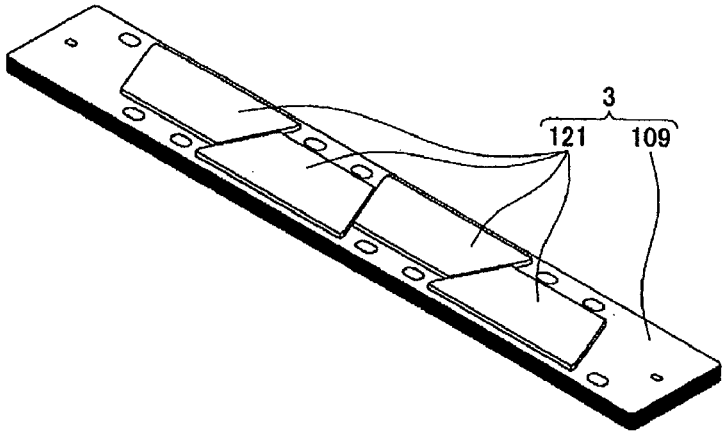
FIGS. 7A and 7B are a perspective view and an enlarged partial cross-sectional view, respectively, of a head body of an inkjet head including the nozzle plate.

A description will now be given of a head body 3 of an inkjet head 12 functioning as a liquid discharging head that includes the above-described nozzle plate 1. Referring to FIG. 7A, the head body 3 includes a passage unit 109 shaped like a rectangular parallelepiped, and a plurality of, e.g., four, actuator units 121 fixed to an upper surface of the passage unit 109.

Figure 7B:
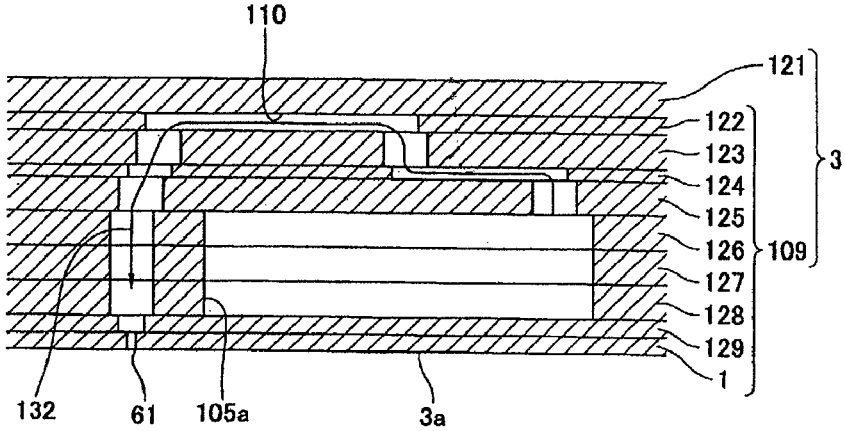

Referring to FIG. 7B, the passage unit 109 includes a plurality of, e.g., nine, plates made of metal, specifically, stainless steel. That is, the passage unit 109 includes, in order from the top, a cavity plate 122, a base plate 123, an aperture plate 124, a supply plate 125, manifold plates 126, 127, and 128, a cover plate 129, and a nozzle plate 1. These plates 1 and 122 to 129 each have a rectangular planar shape that is elongated in a main scanning direction. By aligning and stacking the plates 1 and 122 to 129, a sub-manifold passage 105*a* functioning as a common ink chamber, and a plurality of ink passages 132 each extending from an outlet of the sub-manifold passage 105*a* to a discharging port 61 via a pressure chamber 110 are formed in the passage unit 109. The cavity plate 122 has a plurality of through-holes functioning as pressure chambers 110.

Each actuator unit 121 includes a plurality of, e.g., three, piezoelectric layers made of a lead zirconate titanate (PZT) ceramics material having ferroelectricity. Individual electrodes are respectively provided in areas on an upper surface of the uppermost piezoelectric layer opposing the pressure chambers. A common electrode is provided between the entire uppermost piezoelectric layer and the entire piezoelectric layer provided thereunder.

The common electrode is grounded so that an equal reference potential is applied to the areas corresponding to all pressure chambers. On the other hand, a plurality of individual electrodes are independently and electrically connected to a control unit 32 (see FIG. 8). For this reason, the control unit 32 may supply a driving signal only to a desired one or desired ones of the electrodes. In other words, in the actuator unit 121, a plurality of portions, which are aligned with the individual electrodes in plan view, are selectively made active, and function as independent actuators. That is, the actuator unit 121 may include the same number of actuators as the number of pressure chambers 110.

Figure 8:
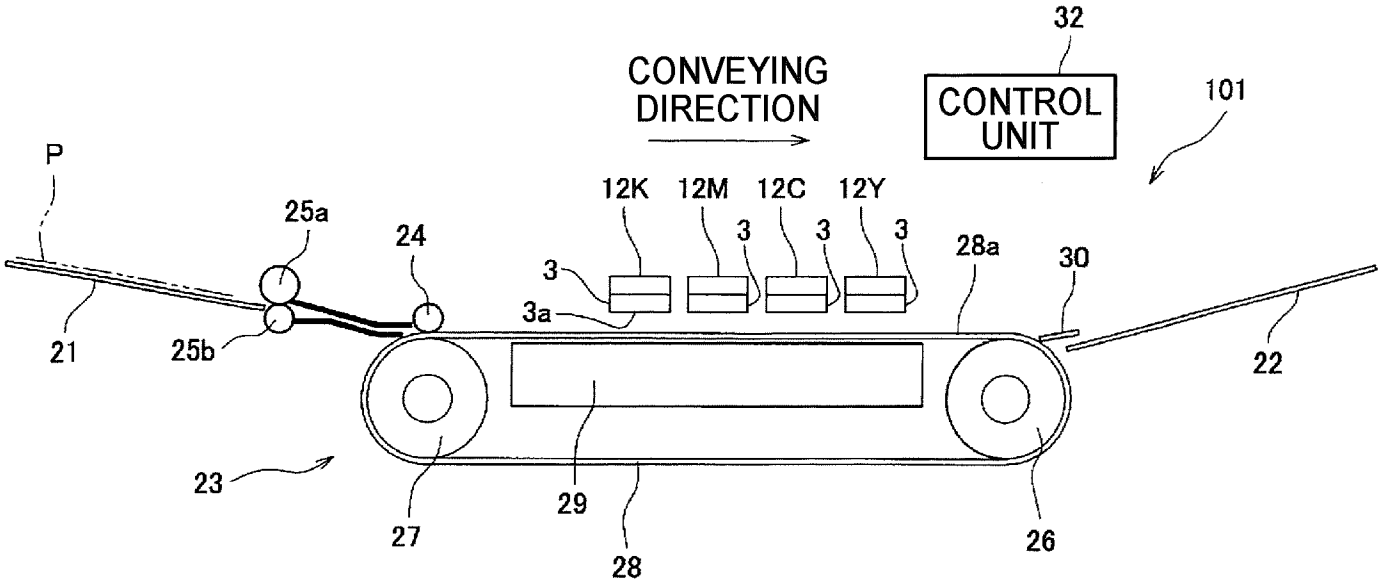
FIG. 8 is a side view of an inkjet printer including the inkjet head.

Referring to FIG. 8, a description will now be given of an inkjet printer 101 functioning as a liquid discharging apparatus including a plurality of, e.g., four, inkjet heads 12K, 12M, 12C, and 12Y each of which includes the head body 3 shown in FIGS. 7A and 7B. This inkjet printer 101 includes the plurality of inkjet heads 12K, 12M, 12C, and 12Y (liquid discharging heads) having the same structure. The plurality of inkjet heads 12K, 12M, 12C, and 12Y respectively discharge inks of a plurality of, e.g., four, different colors (black, magenta, cyan, and yellow).

The inkjet printer 101 also includes a sheet supply tray 21 and a sheet ejection tray 22 on the left and right sides in FIG. 8, respectively. In the inkjet printer 101, a conveying path extends from the sheet supply tray 21 toward the sheet ejection tray 22, and a sheet P functioning as a recording material is conveyed along the conveying path. A pair of feeding rollers 25*a* and 25*b* for nipping and conveying the sheet P are provided just downstream of the sheet supply tray 21. The feeding rollers 25*a* and 25*b* feed the sheet P out from the sheet supply tray 21 to the right in FIG. 8. The feeding roller 25*a* is rotated by a motor (not shown).

In the middle of the conveying path, a conveying belt mechanism 23 is provided. The conveying belt mechanism 23 includes a plurality of, e.g., two, belt rollers 26 and 27, an endless conveying belt 28 stretched by the rollers 26 and 27, a platen 29 provided in a region surrounded by the conveying belt 28 and opposing the plurality of inkjet heads 12K, 12M, 12C, and 12Y with the conveying belt 28 disposed therebetween. The platen 29 supports the conveying belt 28 so that the conveying belt 28 does not bend downward in the region opposing the plurality of inkjet heads 12K, 12M, 12C, and 12Y.

A nip roller 24 is provided on the belt roller 27. The nip roller 24 presses a sheet P, which is fed out from the sheet supply tray 21 by the feeding rollers 25*a* and 25*b*, against an outer peripheral surface of the conveying belt 28. A silicon resin layer having a small adherence is provided on the outer peripheral surface of the conveying belt 28.

When a motor (not shown) rotates the belt roller 26 functioning as a driving roller, the conveying belt 28 rotates. Thus, the conveying belt 28 conveys the sheet P, which is pressed against the outer peripheral surface of the conveying belt 28 by the nip roller 24, toward the sheet ejection tray 22 while adhesively holding the sheet P. A separation plate 30 is provided just downstream of the conveying belt 28 along the conveying path. The separation plate 30 separates the adhering sheet P from the outer peripheral surface of the conveying belt 28.

The plurality of inkjet heads 12K, 12M, 12C, and 12Y are arranged in the conveying direction of the sheet P, and are fixed at positions opposing the platen 29. That is, the inkjet printer 101 may be a line printer. Each of the inkjet heads 12K, 12M, 12C, and 12Y is shaped like a rectangular parallelepiped that is elongated in a direction orthogonal to the paper plane of FIG. 8, that is, in the main scanning direction. A head body 3 is fixed to a lower side of each inkjet head. A bottom face of the head body 3 opposes a conveying surface 28*a* functioning as an upper peripheral surface of the conveying belt 28, and forms a discharging surface 3*a* on which a plurality of discharging ports 61 are provided.

As described above, the discharging ports 61 are two-dimensionally arranged in each head. The pitch of the discharging ports 61 on the discharging surface 3*a* in the main scanning direction corresponds to the print resolution in the main scanning direction (e.g., 600 dpi in this embodiment).

While the sheet P conveyed by the conveying belt 28 passes under the plurality of heads in order, color ink droplets are discharged from the discharging ports 61 provided in the discharging surfaces 3*a* of the heads onto an upper surface of the sheet P, that is, a printing surface. The color inks discharged from the discharging ports 61 of the plurality of inkjet heads 12K, 12M, 12C, and 12Y form a color image on the sheet P in a desired pattern.

Operations of the components of the inkjet printer 101 are controlled by the control unit 32.

During use of the apparatus, ink mist, paper dust, or the like adheres to the discharging surface 3*a* on which the discharging ports 61 for discharging ink open. This adhesion of foreign substances hinders the next ink discharging operation. Accordingly, a purge operation for forcibly discharging ink from the discharging ports 61 is performed to overcome ink clogging and so on. However, ink remains on the discharging surface 3*a* after the purge operation. The purge operation is performed when a predetermined period elapses from the previous discharging operation in a state in which no ink discharging operation is performed, when instructions are given from the user, or when a predetermined period elapses from power-on, regardless of the ink discharging operation.

Figure 9:
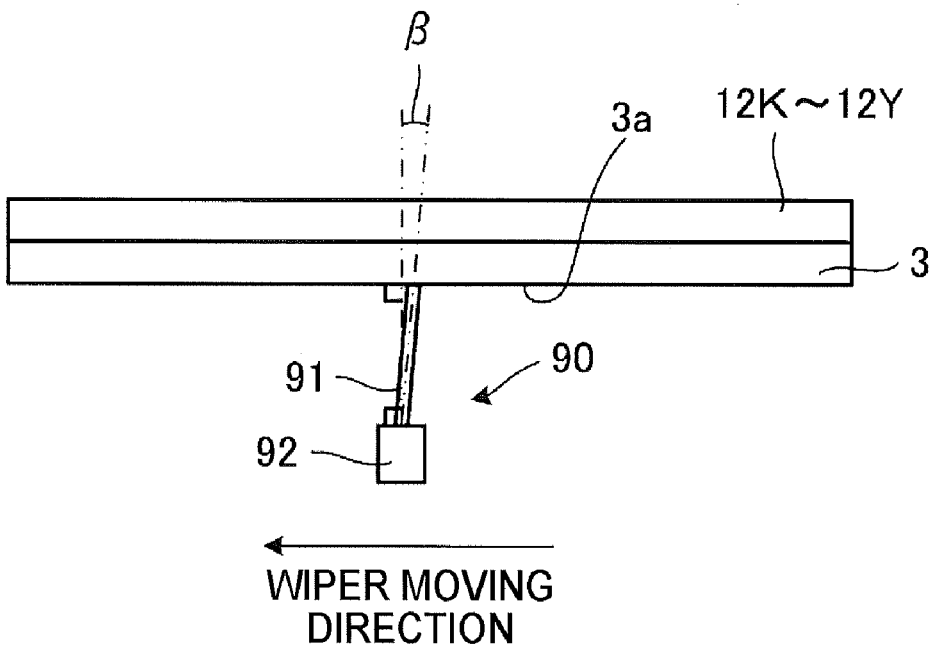
FIG. 9 is a front view of the inkjet printer in a state in which the inkjet head is wiped by a wiper unit.

For this reason, the inkjet printer 101 is provided with a wiper unit 90 for wiping the discharging surface 3*a*. Referring to FIG. 9, the wiper unit 90 includes a wiper blade 91 and a blade base 92. The wiper unit 90 wipes the discharging surface 3*a* of each of the inkjet heads 12K to 12Y by horizontally moving a leading end of the wiper blade 91 in the longitudinal direction of the head while keeping the leading end of the wiper blade 91 in contact with the discharging surface 3*a*. Residual ink is thereby removed from the discharging surfaces 3*a*.

The blade base 92 has an upper surface extending along the discharging surface 3*a* of each of the inkjet heads 12K to 12Y. The wiper blade 91 is formed by a flat plate made of an elastic material, and obliquely extends from the upper surface of the blade base 92 toward the discharging surface 3*a*. That is, as shown in FIG. 9, the wiper blade 91 is fixed to the blade base 92 at a mounting angle β to a direction orthogonal to the upper surface of the blade base 92. The mounting angle β in FIG. 9 is equal to an acute angle formed between the direction of the normal to the plane along the wiper blade 91 and the moving direction of the wiper unit 90.

In relation to the wiper unit 90, the recesses 52 provided on the discharging surface 3*a* are formed so that the taper angle α of the side faces 52*b* shown in FIG. 2 is larger than the mounting angle β of the wiper blade 91. Since the side faces 52*b* of the recesses 52 are at a larger angle to the direction orthogonal to the discharging surface 3*a* than the wiper blade 91, the leading end of the wiper blade 91 may easily scrape off the ink adhering to the side faces 52*b*.

Other advantages of formation of the recesses 52 in relation to the wiper unit 90 are as follows. First, since the leading end of the wiper blade 91 does not easily touch a water repellant film 56 having a thickness less than the depth of the recesses 52, that is, the height difference between the discharging surface 3*a* and the bottom faces 52*a*, damage to the water repellant film 56 may be minimized. Further, since the leading end of the wiper blade 91 does not easily touch the water repellant film 56, the contact pressure of the wiper with the discharging surface 3*a* may be made higher than before. This may enhance the ink removing ability of the wiper unit 90.

The present invention is not limited to the embodiments described above, and various modifications are possible within the scope of the present invention.

For example, in above-described embodiments, after the through-holes 72 functioning as the nozzle holes 51 are formed in the nozzle plate 1 with the punch 82, the water repellant film 56 is formed on the discharging surface 3*a*. Alternatively, the through-holes 72 may be formed with the punch 82 after the water repellant film 56 is formed. In this case, since the water repellant liquid 76 is applied before the through-holes 72 are formed, it is prevented from entering the through-holes 72.

Further, in above-described embodiments, the nozzle plate 1 having the recesses 52 is applied to the inkjet printer 101. Alternatively, a nozzle plate having the recesses 252 of the second modification may be applied to the inkjet printer 101.

Still further, in above-described embodiments, during pressing for forming the recesses 52, all water repellant films 56 in the regions A, where pressing is performed, may be formed on the bottom faces 52*a*. Alternatively, portions of the water repellant film 56 in the regions A may be formed on the bottom faces 52*a* in a manner such as to be separate from the water repellant film 56.

Yet further, in above-described embodiments, the side faces 52*b* of the recesses 52 may extend outward from the bottom faces 52*a* toward the discharging surface 3*a*. However, the side faces 52 may not always need to extend outward in this way. For example, the side faces 52*b* may be perpendicular to the bottom faces 52*a*.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A manufacturing method for a nozzle plate including a plurality of nozzle holes, the manufacturing method comprising the steps of:

forming a plurality of through-holes extending through a plate member in a thickness direction of the plate member;

forming a water repellant film in a region of one surface of the plate member where apertures of the through-holes are not positioned; and pressing individual regions on the one surface of the plate member to form recesses in the individual regions, the individual regions respectively including the apertures of the through holes, and the recesses including bottom faces closer to the other surface than the one surface, and to separate at least portions of the water repellant film pressed into the individual regions from the water repellant film formed on the one surface.

2. The manufacturing method for a nozzle plate according to claim 1, wherein the recesses are formed in the pressing step in a manner such that inner surfaces of the recesses extend outward from the bottom faces toward the one surface.

3. The manufacturing method for a nozzle plate according to claim 2, wherein the recesses are formed such that portions between the bottom faces and the one surface extend straight along the inner surfaces of the recesses to define the shortest path.

4. The manufacturing method for a nozzle plate according to claim 2, wherein the recesses are formed such that portions between the bottom faces and the one surface are curved along the inner surfaces of the recesses to define the shortest path.

5. The manufacturing method for a nozzle plate according to claim 2, wherein pressing is performed using a punch including a surface shaped corresponding to a shape of the inner surfaces of the recesses.

6. The manufacturing method for a nozzle plate according to claim 5, wherein the punch further includes a protruding portion protruding in a direction of pressing.

7. A manufacturing method for a nozzle plate including a plurality of nozzle holes, the manufacturing method comprising the steps of:

forming a water repellant film for covering one surface of a plate member;

forming a plurality of holes opening on the other surface of the plate member; and pressing individual regions positioned on the one surface of the plate member and respectively including the holes, as viewed in a thickness direction of the plate member so as (a) to form recesses in the individual regions, the recesses including bottom faces closer to the other surface than the one surface, (b) to separate at least portions of the water repellant film pressed into the individual regions from the water repellant film formed outside the individual regions, and (c) to form through holes extending from the one surface to the holes.

8. The manufacturing method for a nozzle plate according to claim 7, wherein the recesses and through-holes extending straight in a thickness direction of the plate member are formed by pushing a punch, having a surface shaped corresponding to a shape of inner surfaces of the recesses to be pressed in the pressing step and including a protruding portion protruding in a pressing direction, into the individual regions in the pressing direction such that the protruding portion enters from the one surface toward the holes, and wherein the through-holes allow the recesses to communicate with the holes.

9. A manufacturing method for a nozzle plate including a plurality of nozzle holes, the manufacturing method comprising the steps of:

forming a plurality of through-holes extending through a plate member in a thickness direction of the plate member;

forming a water repellant film in a region of one surface of the plate member where apertures of the through-holes are not positioned; and pressing individual regions on the one surface of the plate member, the individual regions respectively including the apertures of the through holes, to separate at least portions of the water repellant film pressed into the individual regions from the water repellant film formed on the one surface.

* * * * *